United States Patent [19]

Schwarz et al.

[11] Patent Number: 4,681,157

[45] Date of Patent: Jul. 21, 1987

[54] CROSSFLOW HEAT EXCHANGER

[75] Inventors: Hans-Dieter Schwarz; Friedrich W. Pietzarka; Werner Lichtenthaler; Ludwig Muhlhaus, all of Dortmund, Fed. Rep. of Germany

[73] Assignee: Uhde GmbH, Fed. Rep. of Germany

[21] Appl. No.: 781,141

[22] Filed: Sep. 27, 1985

[30] Foreign Application Priority Data

Sep. 29, 1984 [DE] Fed. Rep. of Germany ..... 3435911

[51] Int. Cl.[4] ..... F28F 9/22; F28D 7/02

[52] U.S. Cl. ..... 165/145; 165/165

[58] Field of Search ..... 165/165, 145, 9.1

[56] References Cited

U.S. PATENT DOCUMENTS

| | | | |
|---|---|---|---|
| 1,687,236 | 10/1928 | Buffington | 165/165 |
| 2,821,369 | 1/1958 | Hilliard | 165/165 X |
| 3,986,549 | 10/1976 | Huggins et al. | 165/145 X |
| 4,083,400 | 4/1978 | Dziedzic et al. | 165/165 |
| 4,305,455 | 12/1981 | Lipets et al. | 165/145 |

FOREIGN PATENT DOCUMENTS

| | | | |
|---|---|---|---|
| 68089 | 6/1951 | Netherlands | 165/165 |
| 1016313 | 1/1966 | United Kingdom | 165/165 |

*Primary Examiner*—Albert W. Davis, Jr.

*Assistant Examiner*—Richard R. Cole

*Attorney, Agent, or Firm*—Marshall & Melhorn

[57] ABSTRACT

A gas-tight crossflow heat exchanger consisting of a metal casing with two gas inlet nozzles and two gas outlet nozzles, at least one installation cover on the top of the casing, a block consisting of a number of ceramic heat-exchange elements mounted completely accurately in cuboid form with gas ducts arranged in layers one above the other and running at right angles to each other, four side surfaces having gas-duct openings, and the bottom and top surfaces being free of openings, the heat exchanger further consisting of thermal insulation between the metal casing and the block of ceramic heat-exchange elements. Gas-tightness is achieved by each heat-exchange element being provided on all four duct-free edges of each side surface with recesses and elevations, with a sealing strip installed between each opposing elevation and recess, each heat-exchange element being provided on the floor and cover surfaces with at least one recess or elevation and of the same shape, and the thermal insulation between the metal casing and the block of ceramic heat-exchange elements enclosing the block providing non-positive structural locking in the direction of the gas inlet and gas outlet nozzles.

5 Claims, 8 Drawing Figures

CROSSFLOW HEAT EXCHANGER

BACKGROUND OF THE INVENTION

The invention relates to a crossflow heat exchanger, including elements formed of ceramic material. Heat exchangers formed of ceramic materials have in the recent past frequently been proposed for high temperature heat transfer and/or with the use of corrosive heat-exchange media. The present status of technology is disclosed in the following documents:

European Patent Application No. 00 43 113
DE OS No. 29 37 342
DE OS No. 24 28 087
DE PS No. 25 10 893
DE OS No. 29 34 973
DE PS No. 27 07 290
DE PS No. 28 41 571 and
DE PS No. 26 31 092.

Since such heat exchangers are typically suitable for temperatures up to 1,400° C. and, according to the ceramic material employed, are resistant to corrosive media, they are particularly suitable for use in cases where highly heated corrosive gases require cooling or heating. Such ceramic heat exchangers can also be used where condensed phases arise in case of falling short of the dew point. Heat-exchanger modules as described in the last-mentioned publication, are in particular distinguished by a large heat-exchange surface and are available at reasonable prices due to the manufacturing process described.

In the case of conventional heat exchangers including elements formed of metal, only highest quality materials can be used for the manufacture of such heat exchangers, if they can be manufactured at all, with the result that heat transfer is in these cases only possible at extremely high cost.

The last-cited patent document, DE No. 26 31 092, describes a modular-structured heat-exchange element of ceramic material. The invention manages, by means of material selection and the selection of low layer thickness for the separating walls between the individual ducts arranged in layers at right angles to one another, to minimize the risk of damage due to temperature-fluctuations, which has up to now prevented the more widespread use of such ceramic heat exchangers, and simultaneously to maximize the heat-exchange surface available with a given volume. For commercial applications, for large volume throughputs, the individual elements must be formed of extremely large spatial dimensions. However, the manufacture of such large elements presents problems, since, on the one hand, the individual modules, consisting of "green" (unfired) ceramic mass, must be fired after assembly to produce a heat-exchange element. Large firing chambers and careful cooling processes are necessary for this purpose, in order to prevent the occurrence of cracking due to thermal stresses. On the other hand, such large elements can only be transported at extremely great risk. If damage occurs to such large elements, the entire element becomes useless.

In DE No. 26 31 092, the inventor achieves an enlargement of the heat-exchange surface and an enlargement of throughput of heat-exchange media by creating double-modules, which can be assembled to form a larger unit by means of a system of separating walls, In Patent Document DE No. 27 07 290, the invention discloses a heat exchanger, structured from individual elements, which can be assembled to form larger units with intermediate layers including ceramic-fibre material. Openings, through which the heat-exchange media flow, are provided to fit together precisely by means of a web and groove system.

In Patent Document DE No. 29 34 973, a heat-exchange element is provided by adhesively joining ribbed layers of ceramic material. The heat-exchange element thus obtained is then surrounded with a metallic casing consisting of plates. The plates are pressed by means of bolts, screws and springs against the side surfaces of the heat-exchange element, requiring the sealing materials to be resilient and flexible. This invention does not envisage the assembly of several heat-exchange elements to form a larger unit.

In Patent Document DE No. 25 10 893, discloses a recuperator, constructed of individual brick-shapes. In each case, two brick-shapes are employed to form a duct for one heat-exchange medium. Not until the third brick-shape is added is there a channel formed for a second heat-exchange medium. The assembly of a recuperator is carried out in accordance with the invention described in such a way that an existing chamber is lined with brick-shapes and wall-bricks. The brick-shapes fitting into one another by means of a tongue and groove system. Short-circuiting flow between the two heat exchanger media can be avoided where necessary by means of cementing using mortar. Due to the size of the brick-shapes, the ratio of heat-exchange surface to the volume of the recuperator is relatively small. Reduction in size of the ducts, which signifies an increase in the heat-exchange surface in a given volume, is practically impossible using the brick-shapes proposed, since, with decreasing brick-shape size, cementing becomes more and more difficult, and a technologically interesting ratio for heat-exchange surface to recuperator volume can thus not be achieved.

In Patent Document DE No. 29 37 342, a larger unit is assembled from individual heat-exchange elements, which are clamped against one another by means of bolts, screws, and springs.

European Patent Application No. 0 043 113 discloses a crossflow heat exchanger consisting of ceramic heat exchanger modules which are pressed against one another by means of a clamping mechanism, consisting of screws, bolts, and springs, and thus brought into gas-tight contact.

SUMMARY OF THE INVENTION

For the present invention, the task of assembling individual crossflow heat-exchange elements to form larger units in such a way that the channels for the heat-exchange media, which cross one another, are separated in a gas-tight manner, is taken as a basis. The heat exchanger in accordance with the invention is composed of the heat-exchange elements of the type described in Patent Document DE No. 26 31 092. These elements are distinguished by the fact that, for instance, with a height of approximate 20 cm up to 60 ducts cross, 30 in each case running parallel to each other, and at a length of approximately 30 cm up to 10 ducts run next to one another.

In accordance with the present invention, the solution of this problem can be found by modifying the heat-exchange elements in such a way that the layer thickness of the upper and lower surfaces of the elements, are enlarged so greatly, and the webs, which form the vertical edges, also enlarged so greatly, that mechanical machining of all heat-exchange element surfaces becomes possible. Machining of the individual heat-exchange elements results in the fact that the element can be provided at the edges of all side surfaces with complete elevations or recesses. The elevations and recesses are shaped in such a way that the elevations form a matrix for the recesses. On respective opposing side surfaces of the heat-exchange elements, there are elevations on the one side, and the corresponding recesses on the opposing side. Furthermore, the side surfaces are provided on all edges with a recess, the cross-section of which forms a quarter of the circumference of a symmetrical duct when several heat-exchange elements are placed together. It can be arranged by machining of the side surface that the internal groups of the side surfaces featuring openings are distanced from the recesses and/or elevations, with the result that a narrow circumferentially closed chamber is produced when two heat-exchange elements are placed together, making it not absolutely necessary that the individual ducts must be arranged precisely congruent to one another. The ceramic heat exchanger in accordance with the invention now has the following structure:

A suitable casing formed of metallic materials, for example, with passages and additions with connecting flanges arranged vertically on one another in one plane, is lined with a temperature-resistant non-compressible, or only slightly compressible material. The floor of the casing is flat, and a recess of the size of, for instance, the crossing area of the passages crossing is located in the cover of the casing. On this recess, there is located a collar firmly connected with the casing, and which features a sealing-surface on its upper edge, and can be closed gas-tight using a suitable cover. The individual heat-exchange elements previously machined in the sense of the present invention are now laid on the floor of this casing, either dry or in a mortar bed, by filling the crossing surfaces of the passage element by element, the arrangement either projecting in all four directions into the passage, or corner elements being fitted into a recess in the lining. After completion of the first layer of heat-exchange elements, the ducts and joints at the points where the edges meet must be sealed by means of a suitable mass. The second layer of heat-exchange elements is structured and made completely analogously. One must proceed in this manner until the complete cross-section of all passages has been provided with heat-exchange elements. After all channels and joints at the point where the edges of the individual heat-exchange elements meet have been sealed using a suitable grouting, the recess on the upper side of the heat exchanger is filled with heat-resistant insulation lining material and the cover secured in a known manner to the collar of the heat exchanger casing using a suitable seal or gasket.

It is particularly advantageous if thermal stresses can be minimized, with the use of suitable materials and selection of suitable layer thickness, possibly by means of selection of materials having differing coefficients of thermal expansion. The heat exchanger casing is maintained relatively cool. In certain instances it may be necessary to employ a forced cooling means. One of the objectives of the invention is aimed at maintaining the thermal expansion of the casing smaller than or equal to that of the group of heat-exchange elements by means of the cooling of the casing. This would require pressure to be exerted on the heat-exchange element group during the operation thereof, and thereby ensure that the individual elements were retained in position and that the formation of cracks or other leak-points, which can be observed where no pressure is used, would be prevented. The heat exchanger casing would thus require no clamping mechanisms.

The invention also contemplates the installation of a ceramic guide apparatus in front of the side surface of the group of heat-exchange elements, which would be supported on the insulation layer or on the casing, and would be suitable for the transfer of compression forces onto the elements contained in the center section.

BRIEF DESCRIPTION OF THE DRAWINGS

The above, as well as other objectives and advantages of the invention will become manifest to one skilled in the art from reading the following detailed description of an embodiment of the invention when considered in the light of the accompanying drawings, in which.

DETAILED DESCRIPTION OF THE PREFERRED EMBODIMENTS

Figure 1:
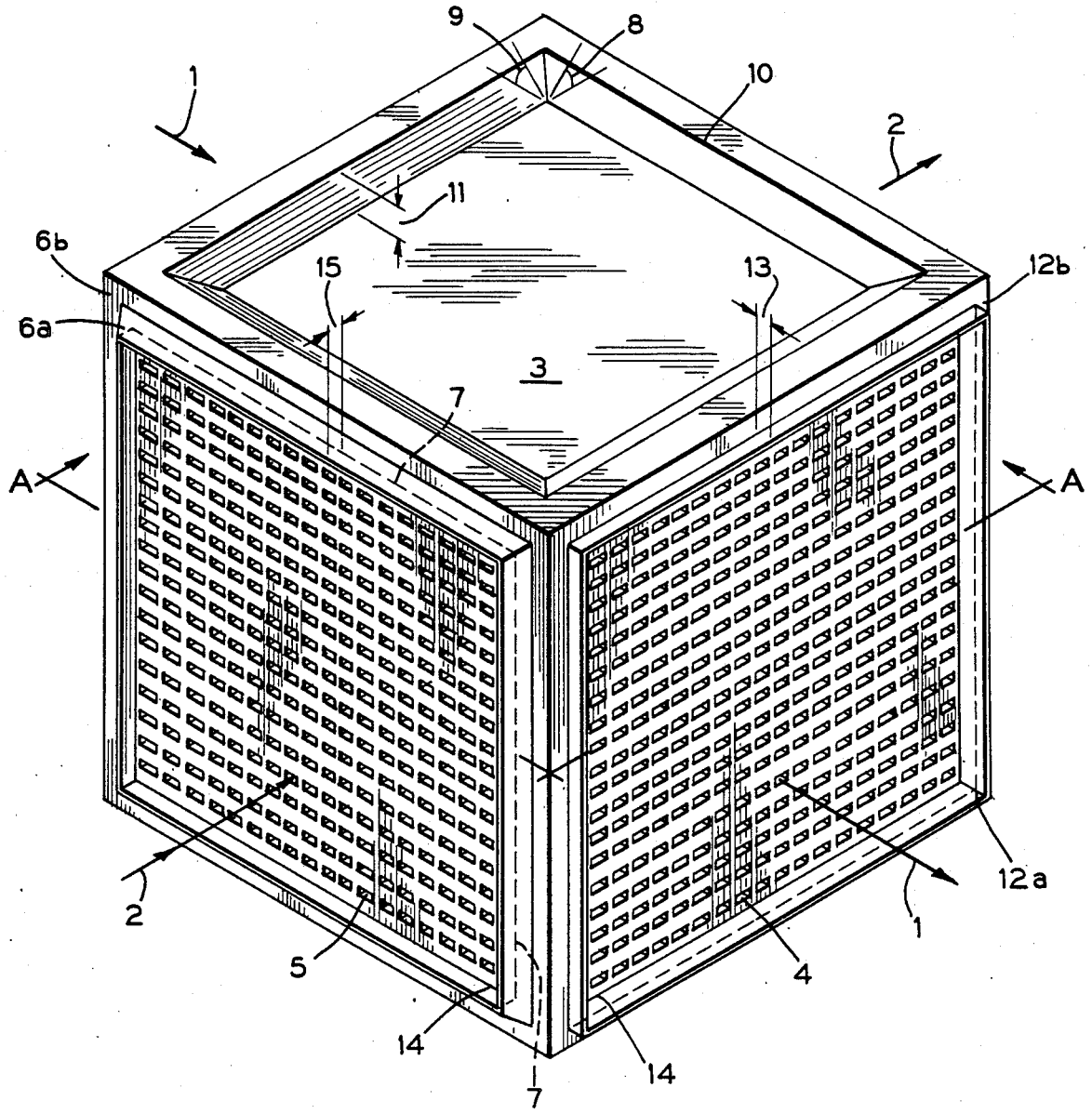
FIG. 1 is a perspective view of a heat-exchange element constructed in accordance with the invention.

A heat-exchange element can be described in detail by referring to FIG. 1. The heat-exchange element 3, is typically cuboid in shape. Two vertical side surfaces and the upper horizontal side surface are illustrated. In the heat-exchange element blank, the side surface extended, before machining in the sense of the invention, through the planes in which the surfaces of the recesses 14 lie in the finished heat-exchange element. The section of the newly created side surfaces provided with openings for the ducts 4 and 5 are now displaced inwardly by the distance 15 from the original side surface. These side surfaces are in the plane indicated by the dotted lines 7. The elevations on the vertical side surfaces initially have a rectangular cross-section **6*b* and, towards the exterior, prismatic section 6*a*, the recess tapering down towards the exterior. At the inlet openings for the media 1 and 2, the right angles in the prismatic cross-section of the recesses are located on the interior side, while they are located on the exterior side of the recesses at the outlets for the media 1 and 2**.

Figure 2:
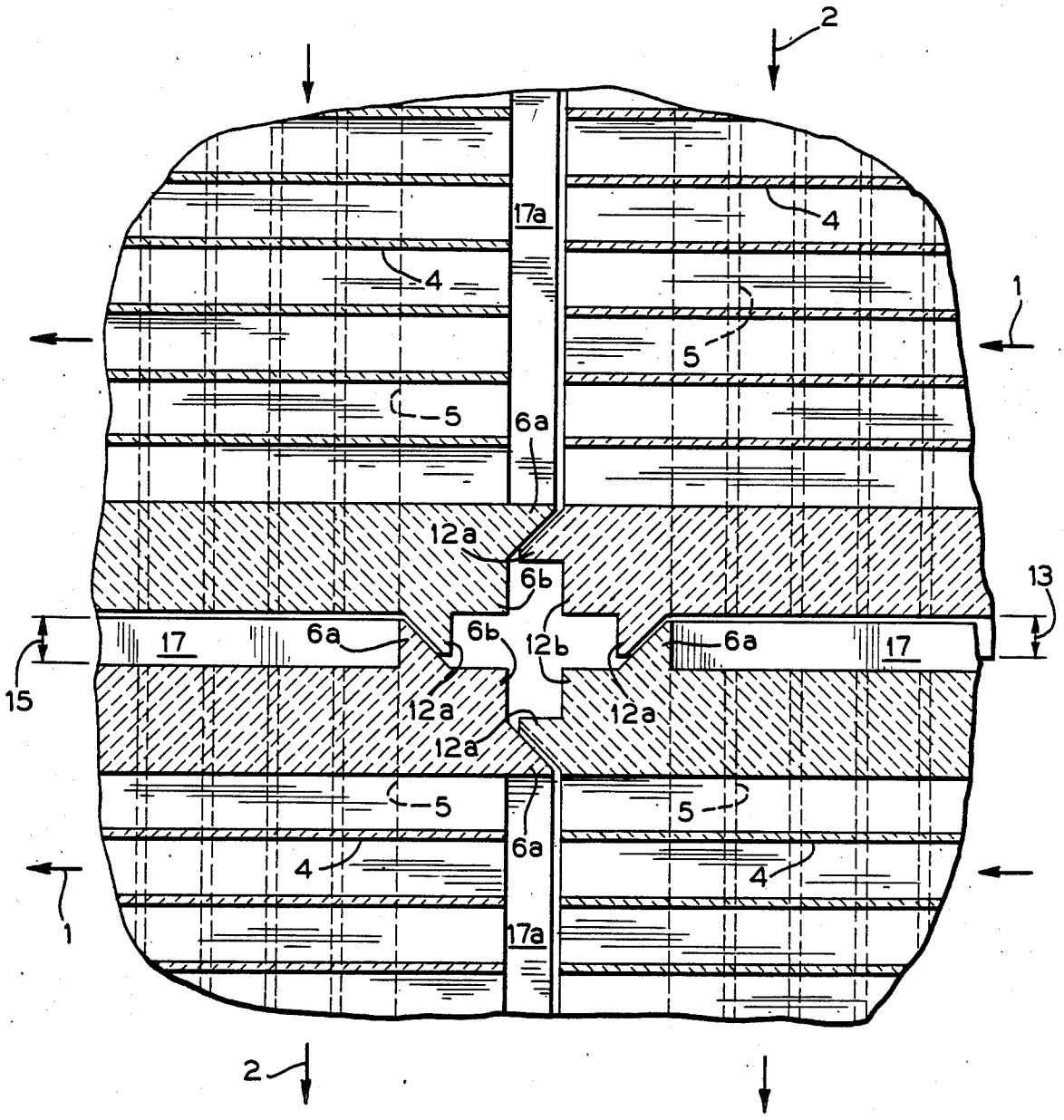
FIG. 2 is an enlarged fragmentary sectional view illustrating the adjacent edges of four elements in accordance with the invention of FIG. 1 in an assembled relationship, the sectioning being substantially in a plane defined by the line a—a in FIG. 1.

On the outlet sides, as for instance, seen in FIG. 2, there is provided a rectangular cross-section of the recess **12*b* and a prismatic cross-section 12*a*. The external surface of the outlet plane is displaced backwards behind the prismatic sectlcn of the recess by distance 13. While the surfaces 6*b* and 12*b* advance over the outlet surfaces, the recesses are indicated by the sidesof the angles 8 and 9 as seen in FIG. 1. The upper and lower sides of the heat-exchange elements have no openings for flow ducts. Here, by way of example, a recess on the upper side is shown, bounded by the edge lines 10 and depressed by distance 11 as seen in FIG. 1. Not shown is an elevation on the underside, also bounded by the edge 10; it projects over the underside by distance 11**. The recesses and elevations on the side surfaces serve the purpose of permitting non-positive placing of several heat-exchange elements adjacent to one another.

Figure 4:
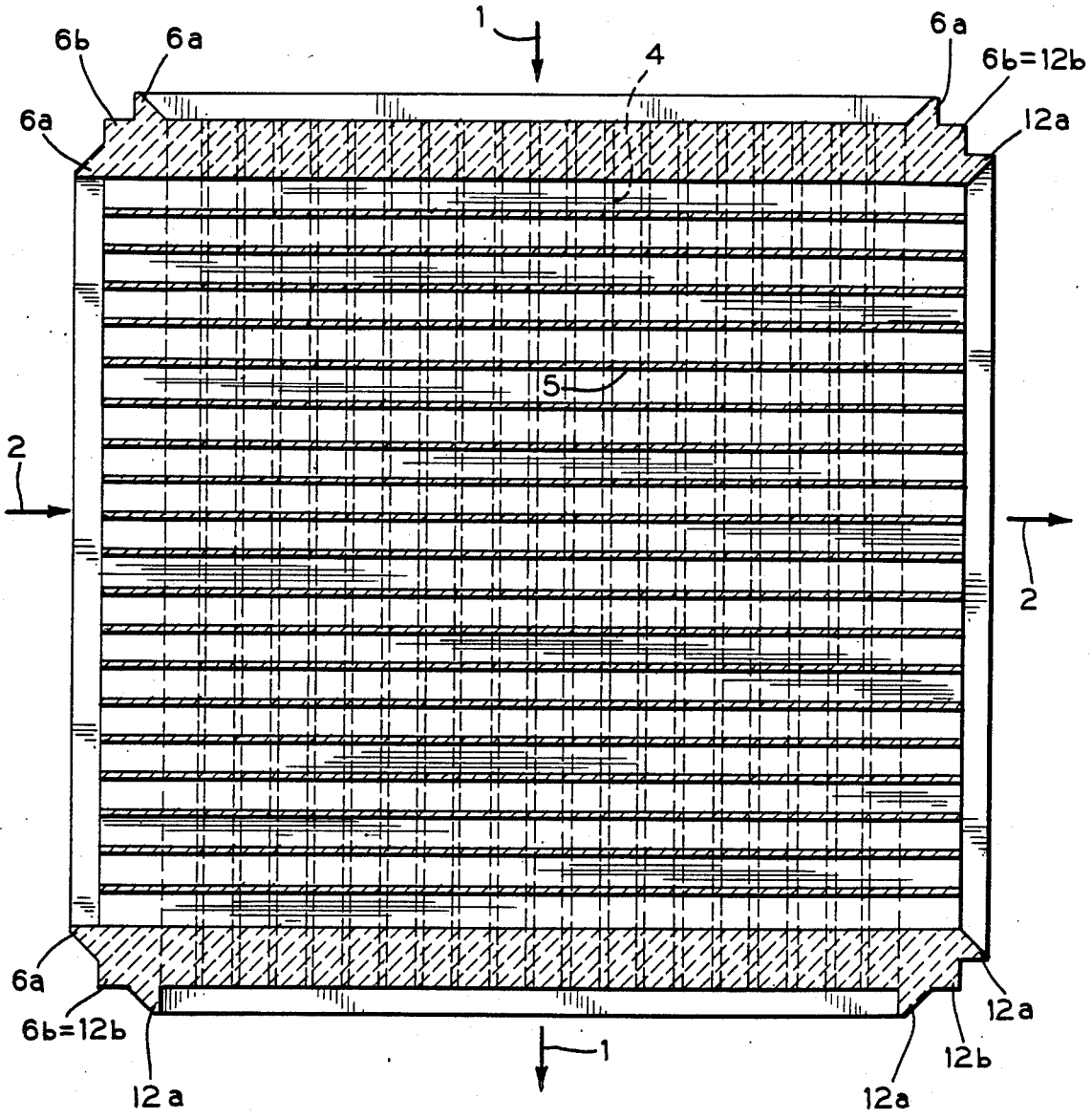
FIG. 4 shows a horizontal section through a heat exchanger element of an alternate embodiment of the invention.
Figure 6:
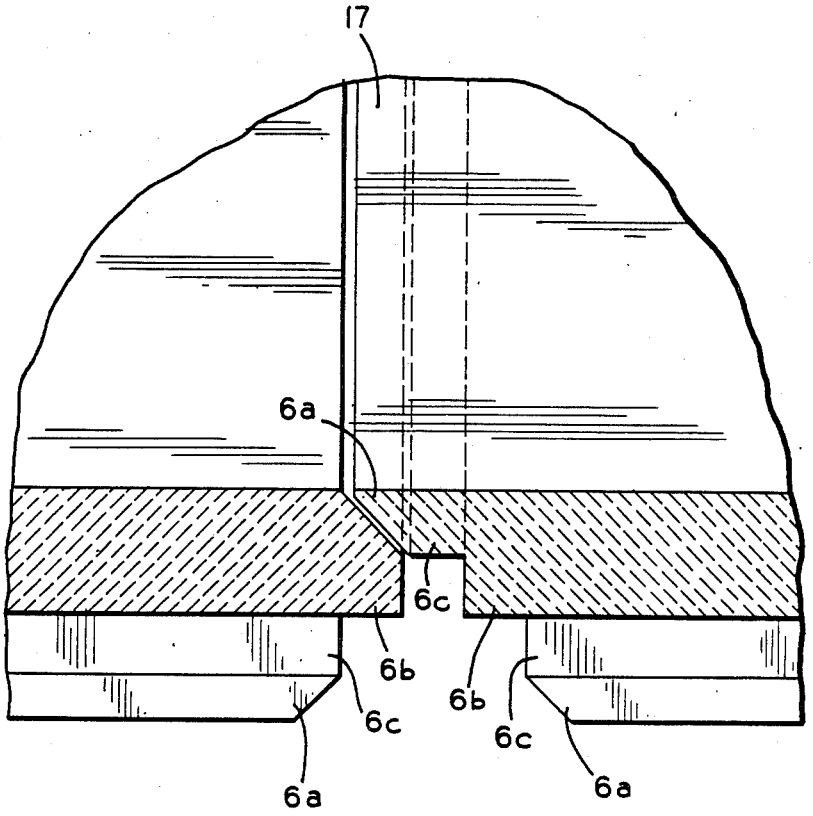
FIG. 6 shows the elevations and recesses provided in the sense of the invention in another alternate embodiment arranged in mirror image to FIG. 2.
Figure 7:
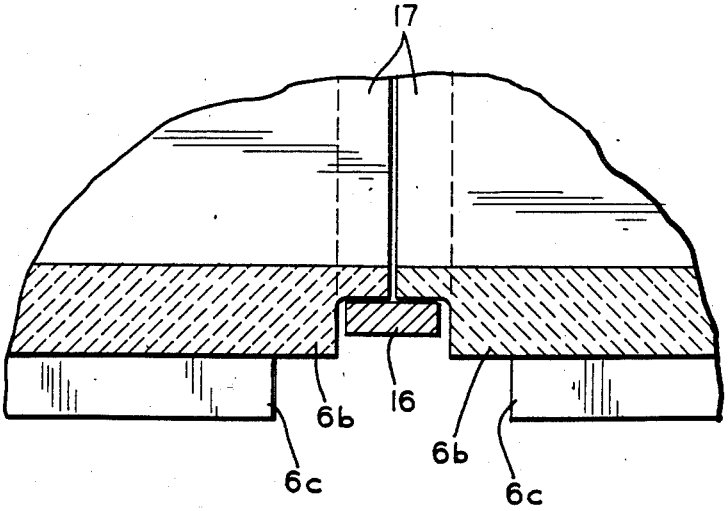
FIG. 7 shows centering of the individual heat-exchange elements using a sleeve.

In FIGS. 4, 6 and 7, three embodiments are shown from the multitude of conceivable shapes for the recesses and elevations. FIG. 4, in deviation from the shape as described up to now, shows an alternate embodiment wherein the heat-exchanger element has rectangular profiled elevations in mirror image on the vertical side surfaces associated with the media. In FIG. 6, the prismatic cross-sections **6*a* are spaced from the rectangular cross-sections 6*b* by an extension wall 6*c*. A ring 16 as seen in FIG. 7, ensures that the individual heat-exchange elements are flush to one another in an alternate embodiment where the prismatic cross-sections 6*a* have been eliminated and the extension ealls 6*c* abut. Furthermore, the ducts 17 and 17*a* formed by combination of individual heat-exchange elements, with, for example, a rectangular cross-section as shown in FIGS. 2, 6 and 7**, are sealed using sealing mass in the spaces formed between opposing recesses and elevations.

Figure 3:
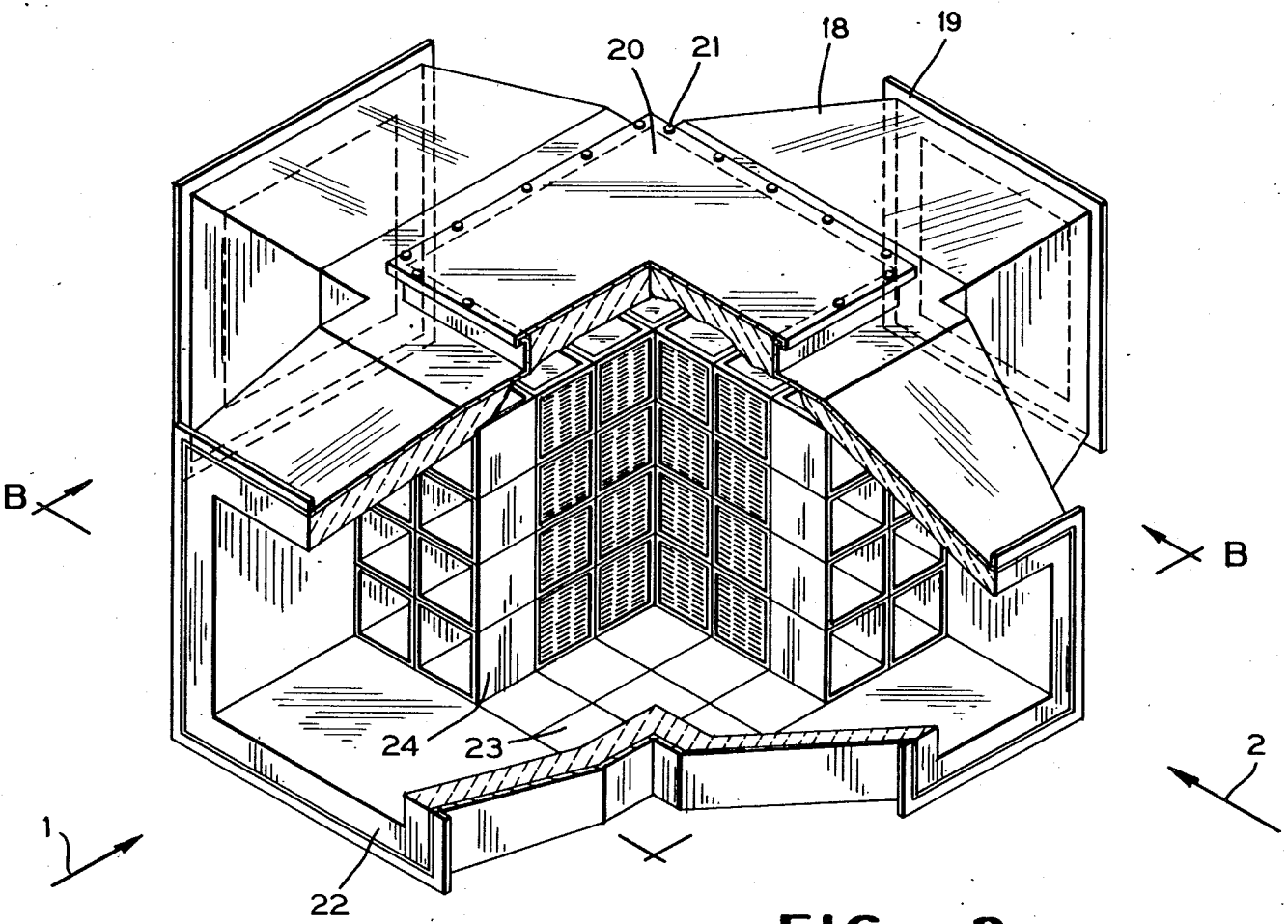
FIG. 3 is a perspective view, partly in section, of a ceramic crossflow heat exchanger constructed in accordance with the invention.
Figure 5:
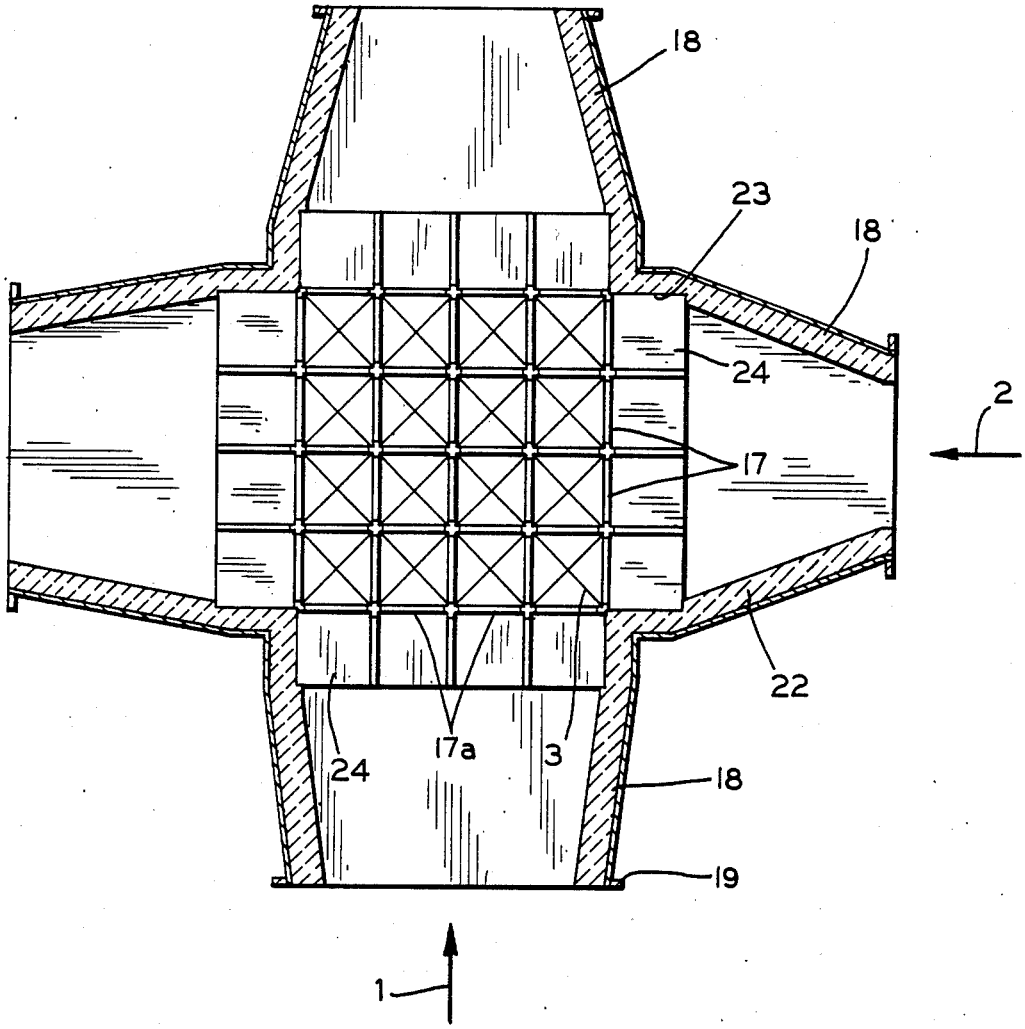
FIG. 5 shows a section through the heat exchanger in a plane defined by the line B—B in FIG. 3.

FIGS. 3 and 5 shows by way of example, a version of a cross-flow heat exchanger containing an arrangement of cross-flow heat-exchange elements 3. Four inlet/outlet nozzles 18 are shown, with their appurtenant flange-connections 19 and a cover 20, which is firmly and gastight connected to the body of the heat exchanger by means of bolts 21 as seen in FIG. 3. The direction of flow arrows 1 and 2 in the drawings indicate the direction of flow of two heat-exchange media flowing at right angles to one another.

FIG. 5 shows a section (see plane B—B in FIG. 3) through the heat exchanger shown in FIG. 3. The internal lining 22 as seen in FIG. 5, the heat exchanger, and the inlet and outlet nozzles 18 with their appurtenant flanges 19 are shown schematically. In the center of the heat exchanger, a square arrangement of heat-exchanger elements 3 in the sense of the invention are shown schematically. The heat exchanger elements 3 are interconnected through the ducts 17 and **17*a*. The ducts 17 are formed at the facing ends of the ducts 5 and the ducts 17*a* are formed at the facing ends of the ducts 4 as flat hollow chambers. The ducts 17 and 17*a*associated with one media are sealed against the other media. The side of each of the heat exchange elements 3 facing one of the openings formed by the nozzles 18 is provided with a funnel element 24 which cooperates with the extension 23 of the associated nozzle 18**.

Figure 8:
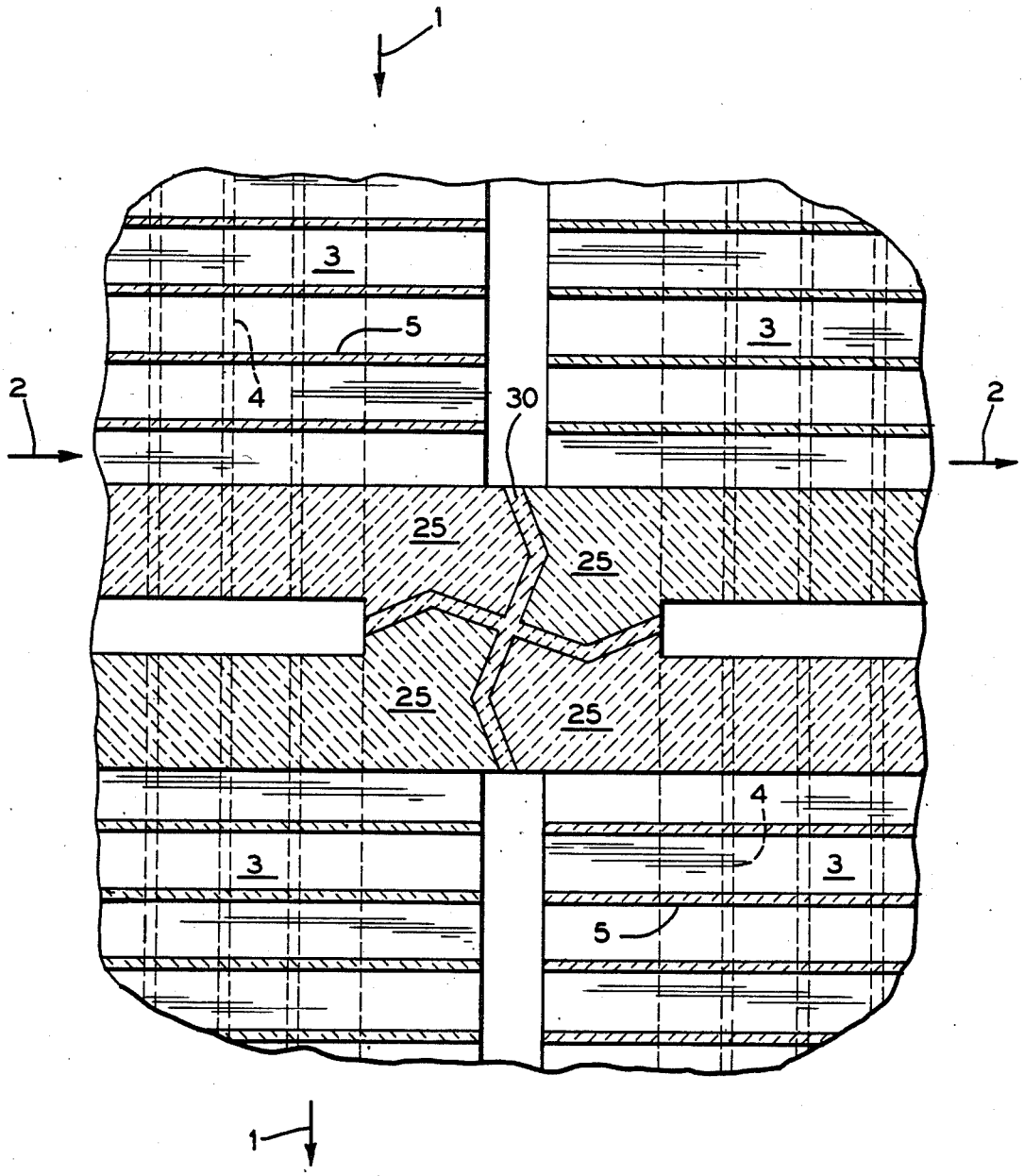
FIG. 8 is a fragmentary view similar to FIG. 2 illustrating a further embodiment of the invention.

FIG. 8 shows by way of example a version of a further idea of the invention as a schematic sectional illustration through the intersecting edges of four heat-exchange elements. A strip or layer of green ceramic mass 30 is laid between suitably shaped elevations and/or outlet surfaces 25 of each element, these being fitted uninterrupted on all sides of the element, and the strip or layer subsequently suitably tempered at sintering temperature without pressure, or under stamping pressure or, for instance, casing pressure, producing a solid, non-jointed and gas-tight connection of the elements (for instance, a hot waste-gas flow is suitable for this purpose).

What is claimed is:

1. A crossflow heat exchanger, comprising:

(a) a body with two gas inlet and two gas outlet nozzles, (b) at least one installation cover on the upper side of the body, (c) a block consisting of a number of ceramic heat-exchange elements mounted completely accurately in a cuboid form with gas ducts layered above one another at right angles to one another, four external side surfaces having gas-duct openings, and the bottom and top surfaces being free of openings, (d) thermal insulation between the body and the block of ceramic heat-exchange elements, (e) elevations and recesses on all peripheral edges of each said side surface of each heat-exchange element, whereby opposing heat-exchange elements fit into one another and the side surfaces are not in contact in the gas-duct area, so that a flat hollow chamber is porduced between adjacent heat-exchange elements, (f) a sealing-strip is fitted between each opposing elevation and recess, and (g) at least one recess or elevation on the bottom and top surfaces of each heat-exchange element, the elements locking positively into one another as said recesses and elevations cooperate with one another.

2. A crossflow heat exchanger according to claim 1, in which the elevations and recesses are profiled on the edge of a side surface and that a space is formed between opposing elevations and recesses, the space being filled with a heat-resistant mass as said sealing strip.

3. A crossflow heat exchanger according to claim 1, in which a plurality of funnel elements are situated on the side surface of the block of heat-exchange elements.

4. In a crossflow heat exchanger having:

(a) a body with two gas inlet and two gas outlet nozzles, (b) at least one installation cover on the upper side of the body, (c) a block including a number of ceramic heat-exchange element mounted completely accurately in a cuboid form with gas ducts layered above one another at right angles to one another, four external side surfaces having gas-duct openings, and the bottom and top surfaces being free of openings, and (d) thermal insulation between the body and the block of ceramic heat-exchange elements, the improvement comprising, (e) elevations and recesses formed on all four peripheral edges of each side surface of each heat-exchange element, so that opposing heat-exchange elements fit into one another and the side surfaces are not in contact in the gas-duct area, so that a flat hollow chamber is formed between adjacent heat-exchange elements, (f) a sealing-strip located between each opposing elevation and recess, and (g) each heat-exchange element having at least one recess or elevation on the bottom and top surfaces, whereby the elements lock positively into one another as said recesses and elevations cooperate with one another.

5. A crossflow heat exchanger according to claim 4 in which the elevations and recesses are profiled on the edge of a side surface and that a space is formed between opposing elevations and recesses, the space being filled with heat-resistant mass as said sealing strip.

* * * * *